US010180121B1

(12) United States Patent
Waisanen et al.

(10) Patent No.: US 10,180,121 B1
(45) **Date of Patent: *Jan. 15, 2019**

(54) OUTBOARD MOTOR WITH SOUND ENHANCEMENT DEVICE AND METHOD FOR MODIFYING SOUNDS PRODUCED BY AIR INTAKE SYSTEM OF AN OUTBOARD MOTOR

(71) Applicant: Brunswick Corporation, Lake Forest, IL (US)

(72) Inventors: Andrew S. Waisanen, Fond du Lac, WI (US); Jeffrey C. Etapa, Oakfield, WI (US); Wayne M. Jaszewski, Jackson, WI (US)

(73) Assignee: Brunswick Corporation, Mettawa, IL (US)

( * ) Notice: Subject to any disclaimer, the term of this patent is extended or adjusted under 35 U.S.C. 154(b) by 32 days.

This patent is subject to a terminal disclaimer.

(21) Appl. No.: 15/091,007

(22) Filed: Apr. 5, 2016

(51) Int. Cl.

| | |
|---|---|
| ***F02M 35/12*** | (2006.01) |
| ***F02M 35/16*** | (2006.01) |
| ***F02D 9/02*** | (2006.01) |
| ***F02B 61/04*** | (2006.01) |

(52) U.S. Cl.
CPC ..... *F02M 35/1294* (2013.01); *F02B 61/045* (2013.01); *F02D 9/02* (2013.01); *F02M 35/167* (2013.01)

(58) Field of Classification Search
CPC ..... F02M 35/1294; F02M 35/167; F02B 61/045; F02D 9/02
See application file for complete search history.

(56) References Cited

U.S. PATENT DOCUMENTS

| | | | |
|---|---|---|---|
| 4,522,602 | A | 6/1985 | Okazaki |
| 4,734,070 | A | 3/1988 | Mondek |
| 4,778,029 | A | 10/1988 | Thornburgh |
| 4,846,300 | A | 7/1989 | Boda |
| 5,083,538 | A | 1/1992 | Hubbell |

(Continued)

OTHER PUBLICATIONS

K.C. Colwell, Faking It: Engine-Sound Enhancement Explained, Car and Driver Website, Apr. 2012, available at http://www.caranddriver.com/features/faking-it-engine-sound-enhancement-explained-tech-dept, 7 pages.

(Continued)

*Primary Examiner* — David Hamaoui
(74) *Attorney, Agent, or Firm* — Andrus Intellectual Property Law, LLP

(57) ABSTRACT

An outboard motor includes an internal combustion engine and a cowl covering the engine. An air vent allows intake air into the cowl, an air intake duct routes the intake air from the air vent to the engine, and a throttle body meters flow of the intake air from the air intake duct into the engine. A sound enhancement device is located proximate the throttle body. A sound duct is provided, and has an inlet end located proximate the sound enhancement device and an outlet end located proximate an outer surface of the cowl. The sound enhancement device is tuned to amplify a first subset of sounds having a desired frequency that are emitted from the throttle body, and the sound duct transmits the amplified sounds to an area outside the cowl. A method for modifying sounds produced by an air intake system of an outboard motor is also provided.

15 Claims, 5 Drawing Sheets

(56) References Cited

U.S. PATENT DOCUMENTS 6,413,131 B1 * 7/2002 Phillips ..... F02B 61/045 123/198 E
6,647,956 B1 11/2003 Sharpton
6,722,467 B1 4/2004 Kusche et al.
6,830,024 B2 12/2004 Kodweiss et al.
6,932,189 B2 * 8/2005 Helber ..... F01N 1/06 123/184.59
7,021,262 B1 4/2006 Belter et al.
7,188,703 B2 3/2007 Hofmann et al.
7,299,783 B1 11/2007 Broman et al.
7,350,496 B2 * 4/2008 Nakayama ..... F02M 35/125 123/184.57
7,353,791 B2 * 4/2008 Sasaki ..... F02M 35/10019 123/184.53
7,448,353 B2 * 11/2008 Shinada ..... F02M 35/04 123/184.53
7,506,626 B2 * 3/2009 Sasaki ..... F02M 35/1294 123/184.53
7,524,223 B2 * 4/2009 Ochiai ..... B63H 20/32 440/88 A
7,621,370 B2 * 11/2009 Abe ..... F02M 35/10137 123/184.57
7,845,466 B2 12/2010 Kostun et al.
RE42,490 E * 6/2011 Takeuchi ..... F02M 35/10295 123/184.53
7,967,106 B2 * 6/2011 Ross ..... F02M 35/1266 123/184.53
8,011,469 B2 * 9/2011 Olson ..... F02M 35/1294 123/184.53
8,127,888 B1 * 3/2012 Mah ..... F02M 35/1216 123/184.53
8,322,486 B2 * 12/2012 Ohta ..... F02M 35/1294 123/184.57
8,384,528 B2 2/2013 McCarthy et al.
8,651,906 B1 2/2014 Morton
8,666,088 B2 * 3/2014 Khami ..... F02M 35/1294 381/71.4
8,684,132 B2 4/2014 Mullet et al.
8,776,755 B2 7/2014 Muller et al.
9,359,981 B1 * 6/2016 Waisanen ..... F02M 35/167
9,429,117 B2 * 8/2016 Takahashi ..... G10K 11/22
9,909,545 B1 * 3/2018 Waisanen ..... F02M 35/10242
2005/0121254 A1 * 6/2005 Hofmann ..... F01N 13/00 181/237
2005/0121255 A1 * 6/2005 Hofmann ..... G10K 11/22 181/250
2005/0133300 A1 6/2005 Hofmann
2007/0054569 A1 3/2007 Murai et al.
2007/0292281 A1 12/2007 Sasaki et al.
2009/0078497 A1 3/2009 Ishizuka et al.
2011/0147116 A1 6/2011 Olson
2014/0055258 A1 2/2014 Grosse-Budde

OTHER PUBLICATIONS

Waisanen et al., Outboard Motor With Sound Enhancement Device and Method for Modifying Sounds Produced by Air Intake System of an Outboard Motor, Unpublished U.S. Appl. No. 14/707,229, filed May 8, 2015.

* cited by examiner

OUTBOARD MOTOR WITH SOUND ENHANCEMENT DEVICE AND METHOD FOR MODIFYING SOUNDS PRODUCED BY AIR INTAKE SYSTEM OF AN OUTBOARD MOTOR

FIELD

The present disclosure relates to air intake systems for internal combustion engines associated with outboard motor propulsion systems.

BACKGROUND

U.S. Pat. No. 4,846,300, hereby incorporated by reference, discloses a marine engine with a multi-section injection-molded thermoplastic air box directing air to the fuel system's air intake throat and silencing engine noise emitted back through the throat. The air box has a cover section and a base section mounted to each other solely by a seal along a peripheral seam around the entire perimeter thereof, to prevent fuel leaks. The housing sections are preassembled to each other prior to mounting to the air intake throat. A removeable plug in the cover section allows access through the cover section to bolts mounting the base section to the throat. Access is also enabled to a fuel adjustment screw to enable adjustment, with the air box fully assembled and mounted in place on the throat, to enable adjustment under actual operating conditions. Air guide passages and an air plenum chamber are all molded in place.

U.S. Pat. No. 5,083,538, hereby incorporated by reference, discloses an air intake system for an internal combustion engine associated with the power head of an outboard marine propulsion system. The engine includes a vertical crank shaft and a flywheel mounted to the crank shaft above the engine block. An air manifold is mounted to the forward side of the engine, and includes an air inlet for receiving intake air. The air intake system includes an air flow path or duct defined by a series of walls, a rearwardly facing air intake opening, and a discharge opening for supplying intake air to the air manifold inlet. The engine is enclosed within a cowl assembly, and the air intake opening is located toward the upper end of the cowl assembly interior. The walls defining the air flow duct are formed integrally with a flywheel cover for facilitating assembly of the air flow duct to the engine. The air flow duct minimizes ingestion of water into the engine and reduces engine noise in the boat.

Unpublished U.S. patent application Ser. No. 14/707,229, filed May 8, 2015, and hereby incorporated by reference, discloses an outboard motor including a system for enhancement of a first subset of sounds having a desired frequency, and a method for modifying sounds produced by an air intake system for an internal combustion engine powering the outboard motor. The method includes collecting sounds emitted in an area proximate a throttle body of the engine. A first subset of the collected sounds, which have frequencies within desired frequency range, is then amplified. The amplified first subset of sounds is then transmitted to an area outside a cowl covering the engine.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One example of the present disclosure includes an outboard motor comprising an internal combustion engine powering the outboard motor and a cowl covering the engine. An air vent allows intake air into the cowl, an air intake duct routes the intake air from the air vent to the engine, and a throttle body meters flow of the intake air from the air intake duct into the engine. A sound enhancement device is located proximate the throttle body. A sound duct is provided, the sound duct having an inlet end located proximate the sound enhancement device and an outlet end located proximate an outer surface of the cowl. The sound enhancement device is tuned to amplify a first subset of sounds having a desired frequency that are emitted from the throttle body, and the sound duct transmits the amplified first subset of sounds to an area outside the cowl.

According to another example of the present disclosure, a method for modifying sounds produced by an air intake system for an internal combustion engine powering an outboard motor is described. The method includes positioning a sound enhancement device in an aperture in an air intake duct that provides intake air to a throttle body of the engine. The method also includes tuning the sound enhancement device so that it amplifies a first subset of sounds emitted by the throttle body that have frequencies within a desired frequency range. The method includes routing a sound duct from the sound enhancement device to an area outside a cowl covering the engine so that the amplified first subset of sounds can be transmitted as sound pressure pulses through the sound duct. Separation is provided between a first passageway defined by the air intake duct and a second passageway defined by the sound duct.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
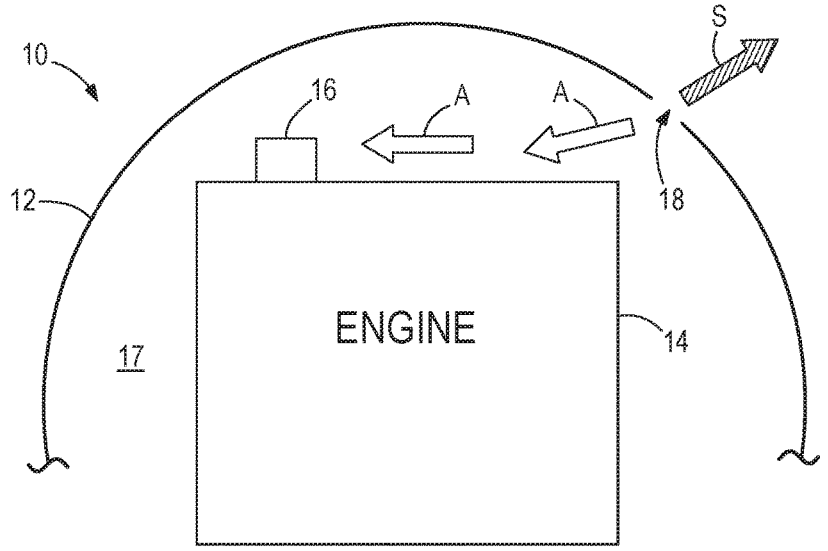
FIG. 1 PRIOR ART
FIG. 1 illustrates one example of a prior art outboard motor air intake system.

FIG. 1 is a simplified schematic illustrating a prior art outboard motor 10 including an upper cowl 12 covering an internal combustion engine 14. As is known, the engine 14 powers a propeller of the outboard motor 10, via a series of connections and gears that couple a crankshaft of the engine 14 to a propeller shaft. A throttle valve located in throttle body 16 meters intake of air into the engine's cylinders, where the air is mixed with fuel and ignited in order to drive the engine's pistons, which movement causes the crankshaft to rotate. Air is provided to the interior of the cowl 12 through an air vent 18, which is shown as a simple hole extending through the cowl 12. However, it should be understood that the air vent 18 can have a flap or shield provided over or around it in order to prevent rain or water from entering the cowl 12.

In the system shown in FIG. 1, air enters through the air vent 18 and, as shown by the arrows labeled "A," flows through the open under-cowl environment 17 toward the throttle body 16, where it then flows past the throttle valve and into the engine 14. The throttle valve can be either electronically or manually actuated. Sound produced by the engine 14, including sound produced by the air intake system (for example due to flow of air past the throttle valve in the throttle body 16) leaves the cowl 12 through the same vent 18, as shown by the arrow labeled "S." Mechanical noise from the engine 14 is also transmitted out of this vent 18, which is often located on the aft end or the side of the cowl 12 in order to transmit the noise away from the operator of the marine vessel to which the outboard motor 10 is coupled. In certain outboard motors, the air intake system is provided with a silencer that attenuates the noise produced by the air intake system, such as described in U.S. Pat. Nos. 4,846,300 and 5,083,538, incorporated herein above. Other components, such as an intake duct that acts as a resonator, may be attached to the vent 18 and/or throttle body 16. The design of such a resonator is typically optimized to balance tradeoffs between performance of the engine 14, packaging of the engine 14 and its components within the cowl 12, and noise vibration and harshness (NVH) characteristics.

Product noise requirements and/or expectations of a given outboard motor can vary greatly depending on the application. For example, performance boaters may desire a louder and/or more powerful sound quality than recreational boaters. However, expectations for sound quality and refinement are universal, and dictated in some geographical areas by law, regardless of the noise level expectations of the customer. The system and method of the present disclosure, described with respect to FIGS. 2-6 below, enhance the powerful, desirable sound characteristics of an outboard motor without sacrificing the requirements and/or expectations for refinement of unpleasant sound.

Figure 2:
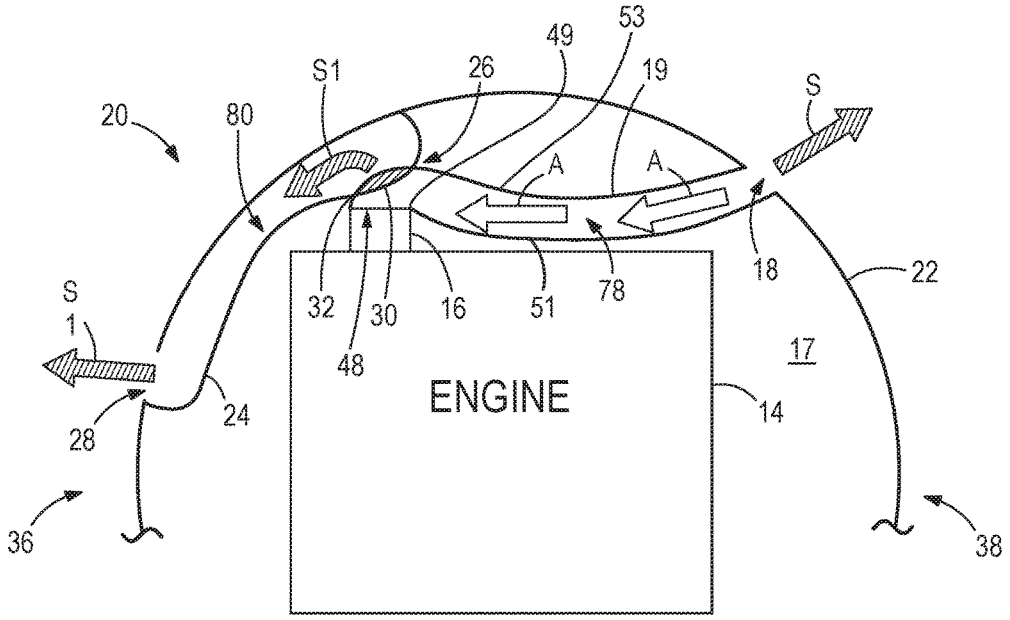
FIG. 2 illustrates one example of an outboard motor air intake system and a sound enhancement system according the present disclosure.

A simplified schematic of an outboard motor 20 according to the present disclosure is shown in FIG. 2. Similar to the outboard motor 10 shown in FIG. 1, the outboard motor 20 includes a cowl 22; however, the cowl 22 has been modified as will be described further herein below. An internal combustion engine 14 powers the outboard motor 10. An air vent 18 allows intake air into the cowl 22, as shown by the arrows labeled "A" and allows sound to escape from the vent 18, as shown by the arrow "S." Here, an air intake duct 19 (defining a first passageway 78) routes the intake air from the air vent 18 to the engine 14. The air intake duct 19 can be of any shape or size and can be built into (integral with) the underside of the cowl 22 for a portion of its structure, or can be a separate piece connected to the cowl 22. The air intake duct 19 can be long and narrow or can be wider and cavernous, such as if it includes a plenum. The air intake duct 19 can act as a resonator, as noted above, or can be provided with a silencer, or both. A throttle body 16 meters flow of the intake air from the air intake duct 19 into the engine 14. The air intake duct 19 is coupled to the throttle body 16 so that intake air is provided directly to the throttle body 16. More specifically, the throttle body 16 has an intake opening 48 situated in an aperture 49 in a first wall 51 defining the first passageway 78.

Unlike the prior art outboard motor 10, the present outboard motor 20 further includes a sound enhancement device 30 located proximate the throttle body 16. Also unlike the prior art, a sound duct 24 is provided. The sound duct 24 has an inlet end 26 located proximate the sound enhancement device 30 and an outlet end 28 located proximate an outer surface of the cowl 22. The sound enhancement device 30 is tuned to amplify a first subset of sounds having a desired frequency that are emitted from the throttle body 16. The inlet end 26 collects sounds that are emitted by the throttle body 16 and amplified by the sound enhancement device 30, and the sound duct 24 transmits the amplified first subset of sounds to an area outside the cowl 22. The sound duct 24 can be made of plastic, the same material as the cowl 22, or another material that is suitable for an under-cowl environment. The sound duct 24 can have a cross-sectional shape of a circle, an oval, a rectangle, or another type of polygon, according to the desired sound effect and the shape of the cowl in which it is located. Several different characteristics, structures, and designs for the sound duct 24 are available. For instance, the shape and diameter of the sound duct 24 can be selected specifically to achieve desired enhancement of sound. The sound duct 24 may be coupled to an inner surface of the cowl 22 as shown here, or could be provided in a number of other ways, as will be described further herein below. If the sound duct 24 is coupled to the cowl 22, this allows the cowl 22 to be removed from the remainder of the outboard motor 10 (for example, from a lower cowl portion) in order to service the engine 14, without needing to make sure the sound duct 24 is detached from the cowl 22 beforehand. In other words, because the sound duct 24 is coupled to the cowl 22, the sound duct 24 is easily removed with the cowl 22.

The sound enhancement device 30 acts as a passive speaker that is tuned to amplify the first subset of sounds that have been collected from the area proximate the throttle body 16. The sound enhancement device 30 adjusts the spectral frequency (sound amplitude vs. frequency) of the first subset of sounds without the use of active components such as, for example, electronic amplifiers. This first subset of sounds can be defined in any way desired by the manufacturer/installer/operator. For example, the first subset of sounds may be sounds that have frequencies within a desired frequency range, such as those that produce what might be considered a pleasant "rumble" that conveys the power of the engine 14 to the operator of the vessel. The sound enhancement device 30 can be tuned to amplify this pleasant rumble such that the operator can hear it better.

In one example, the sound enhancement device 30 comprises a flexible membrane that extends generally transversely across an aperture 32 in the air intake duct 19, as will be described further herein below. The aperture 32 is located in a second wall 53 defining the first passageway 78 that is opposite the first wall 51. The aperture 32 is located directly across from the aperture 49, and the membrane faces the throttle body intake opening 48. The membrane can have any sort of shape that will fill the cross-sectional shape of the aperture 32, and its outer edges can be sealed along an inner perimeter of the aperture 32 so as to isolate the sound duct 24 from air flow in the interior of the air intake duct 19. Thus, the sound duct 24 is not a functional part of the air induction system and does not supply air to the engine 14. The membrane may be made out of any sort of flexible or elastomeric substance, and in one example is a disc made out of rubber. A stiffness of the membrane can be tuned in order to provide a desired amount of amplification of the first subset of sounds (the desirable sounds). The stiffness of the membrane can be varied by stretching the membrane tighter or allowing the membrane to be looser as it spans the aperture 32. Another way in which the acoustic flexure properties of the membrane may be tuned or adjusted is by varying the thickness (and therefore mass and stiffness) of the membrane. Additionally, the composition of the membrane itself and/or products that are applied to the membrane can cause it to exhibit different characteristics upon application of sound waves. Because the sound enhancement system (including sound duct 24 and sound enhancement device 30) is passive, it relies on acoustic excitation of the sound enhancement device 30 by sounds radiating from the throttle body 16 to provide amplification. In alternative embodiments, the sound enhancement device is a membrane made of plastic or of a thin metal sheet attached to a spring that can be tuned to achieve the desired frequency characteristics. The sound enhancement device 30 may also take forms other than that of a membrane, such as a trumpet.

The outlet end 28 of the sound duct 24 is located proximate an outer surface of the cowl 22, so as to deliver the amplified first subset of sounds to the area outside of the cowl 22. In the example shown in FIG. 2, the outlet end 28 ends flush with the cowl 22, but it could be provided to extend through the cowl 22, or it could end inside the cowl 22 in a sound chamber, as will be described further herein below. Further, in the example shown, the outlet end 28 of the sound duct 24 is positioned at a front side 36 of the outboard motor 10. In contrast, the air vent 18 is positioned at the back side 38 of the outboard motor 20. As mentioned above, this allows unpleasant mechanical or air intake noises to exit the cowl 22 remote from the operator. The amplified pleasant sounds exit the cowl 22 closer to the operator. The first subset of sounds (shown by the arrow labeled "S1"), which have been collected and amplified by their passage through the sound duct 24 and by the sound enhancement device 30, are directed toward the operator of the outboard motor, as they are emitted from the front side 36 of the outboard motor 20. Meanwhile, the sounds "S" that are not in the subset "S1" (i.e., sounds that do not have the desired frequency) are emitted via the vent 18, which, because it is located on the back side 38 of the outboard motor, directs the undesired sounds away from the operator. Thus, the operator can better hear the amplified, desirable sounds than he or she can hear the non-amplified remainder of the sounds.

The outboard motor 20 shown in FIG. 2 can also be designed to attenuate a second subset of the sounds. This second subset of collected sounds may have frequencies that are within an undesired frequency range. For example, these may be sounds having a frequency that might be considered annoying to the operator of the outboard motor 20. In order to attenuate the second subset of sounds, the length and/or shape of the sound duct 24 can be selected specifically to provide a desired amount of attenuation. Alternatively or additionally, a stiffness of the membrane of the sound enhancement device 30 can be tuned to provide a desired amount of attenuation of the second subset of sounds. Additionally or alternatively, a sound attenuating device may be provided within the sound duct 24 and/or within the air intake duct 19 so as to provide a desired amount of attenuation of the second subset of sounds. The sound attenuating device could be a small fibrous pad, another type of padded material, or a similar spongey-type material that is designed to attenuate certain frequencies of sounds. Additionally or alternatively, the air intake duct 19 itself could act as or provide a connection to a resonator to attenuate sounds created by the flow of intake air. Therefore, the system provides enhancement of desirable engine sound characteristics, while minimizing unwanted sounds that radiate from cowl openings. By suppressing unwanted sounds and highlighting desirable sounds, a more refined sound quality can be obtained.

As described above, the sound enhancement device 30 is set into an aperture 32 in the air intake duct 19. This aperture 32 could be a simple hole cut into the wall of the air intake duct 19 (FIG. 2), or could be provided in an inverted neck molded or formed integrally with the wall of the air intake duct 19. The inverted neck could be long enough only to hold the sound enhancement device 30 and any retaining devices, as shown at 440 in FIG. 4, or could be long enough to locate the sound enhancement device 30 very close to the throttle body 16, as shown at 340 in FIG. 3, or could be somewhere in between (FIG. 5) depending on the shape of the air intake duct 19 and the desired relative location of the sound enhancement device 30 to the throttle body 16. In the instance where the sound enhancement device 30 is a flexible membrane, retaining rings 42 can be provided on one or both sides of the membrane 50 to hold it within the aperture 32 or neck 340, 440, 540, which can be provided with an inner flange to hold the retaining rings 42.

Figure 3:
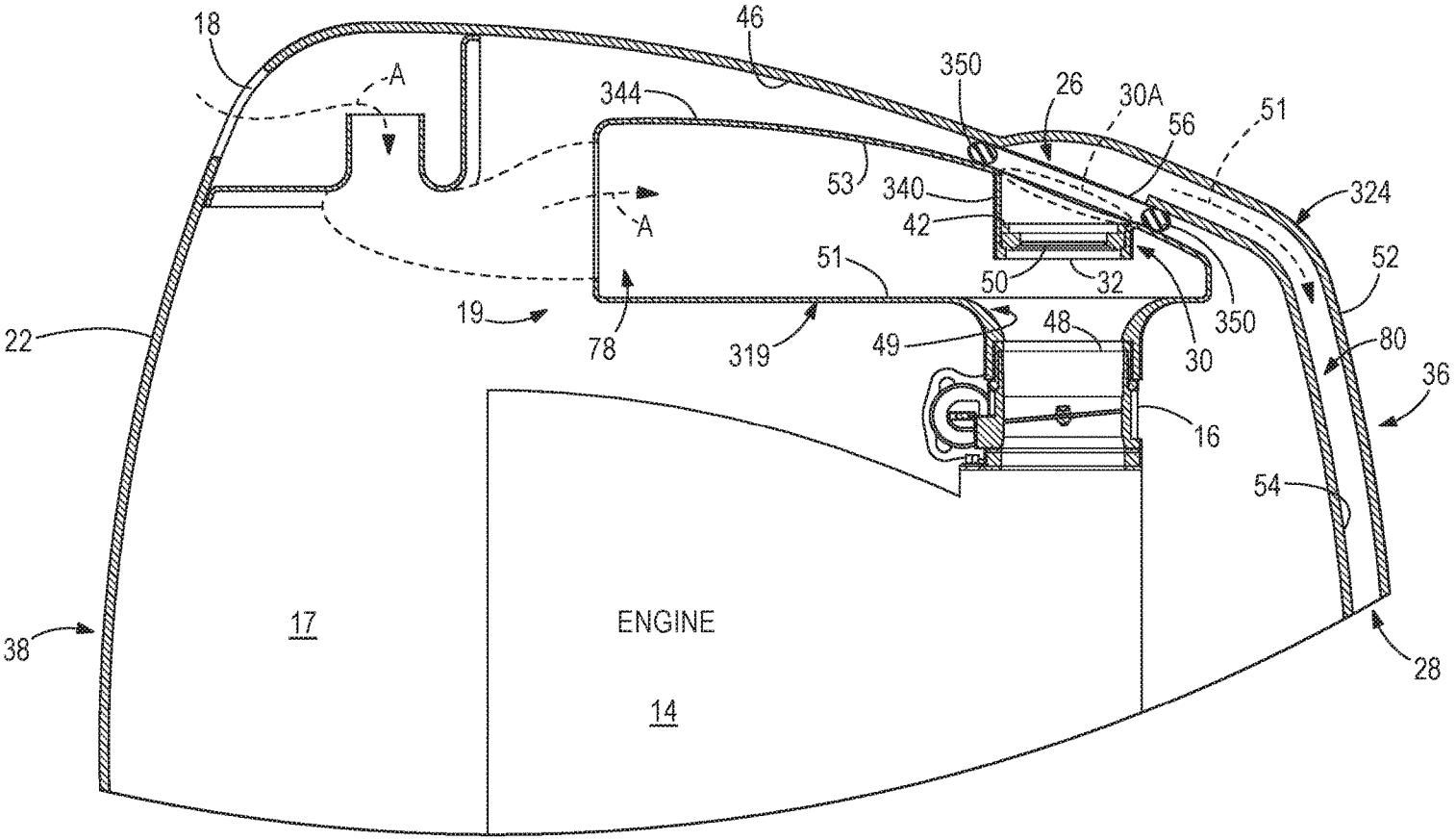
FIGS. 3-5 illustrate cross-sectional views of further examples of outboard motor sound enhancement systems according the present disclosure.
Figure 4:
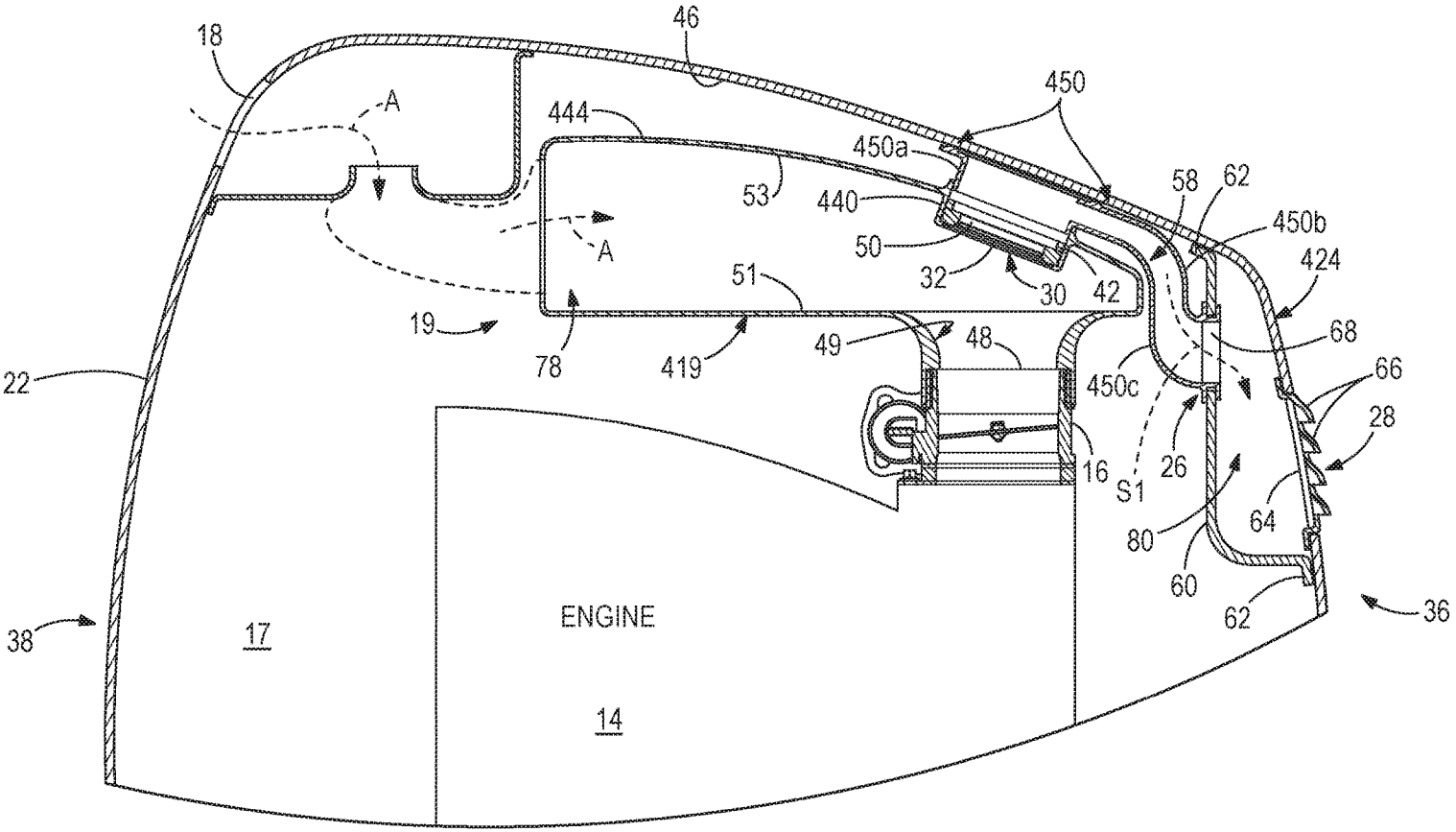
Figure 5:
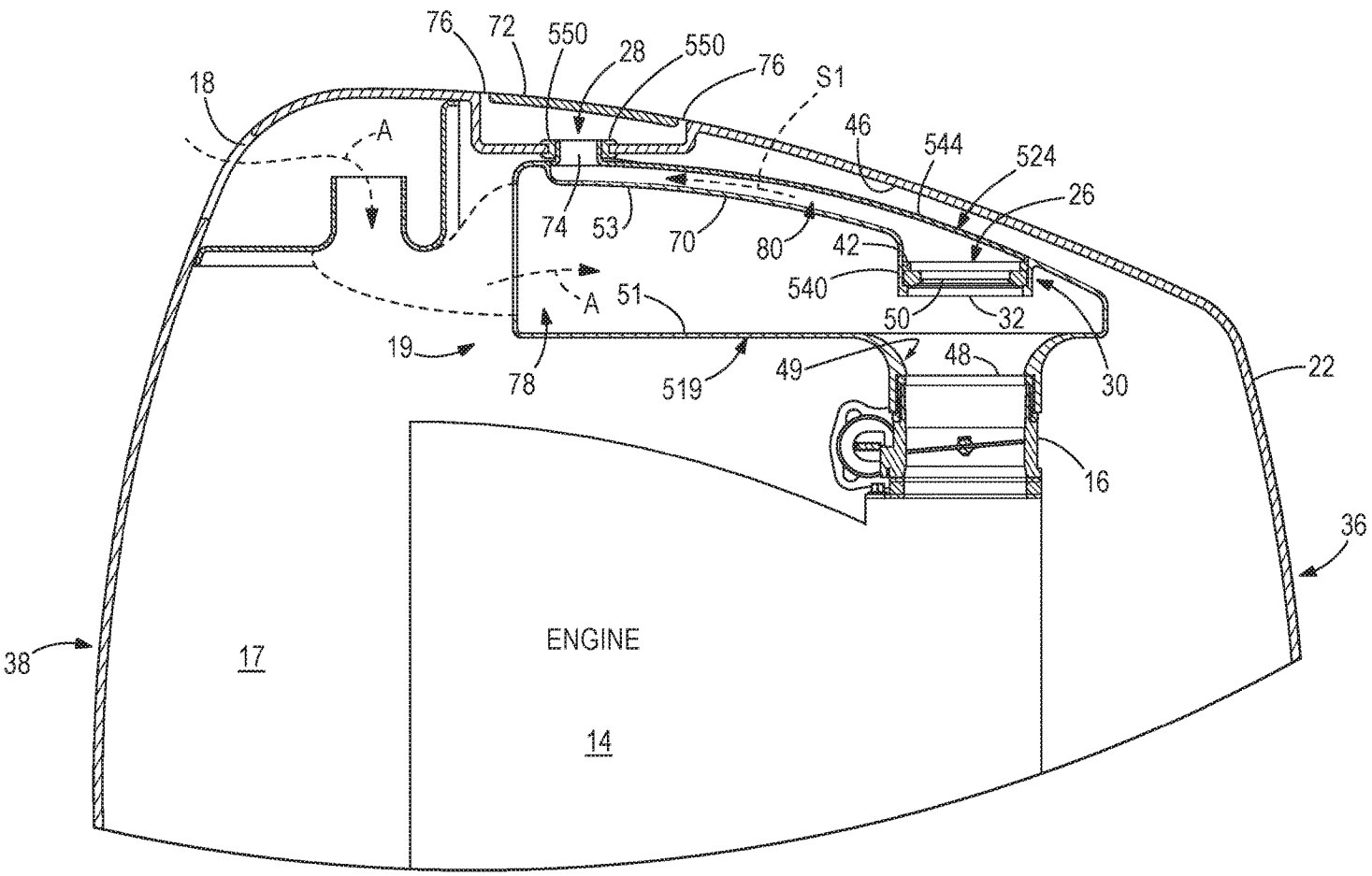

FIGS. 3-5 provide an embodiment in which the air intake duct 19 is expanded at least along a portion of its length into an air intake plenum 319, 419, 519, respectively. As described above, this plenum 319, 419, 519 could also be a resonator or a silencer, depending on its design, and the exact shape, size, and configuration of the plenum are not limiting on the scope of the present disclosure. Alternatively, the air intake duct 19 could continue as a relatively narrow passageway all the way from the vent 18 to the throttle body 16. In either case, the plenum 319, 419, 519 or intake duct 19 is coupled to the throttle body 16 to provide the intake air directly to the throttle body 16 without letting it escape to the open under-cowl environment 17. Each of the air intake plenums 319, 419, 519 shown has an upper wall with an outer surface 344, 444, 544, respectively, that at least partly follows the shape of an inner surface 46 of the cowl 22. The aperture 32 in each plenum is in the upper wall of the plenum. Mimicking of the shape of the inner surface 46 of the cowl 22 allows the air intake plenum 319, 419, 519 to be as large as possible for silencing and/or resonating and/or adequate airflow purposes, while also providing only a short expanse for the amplified sounds from the sound enhancement device 30 to travel before they reach the sound duct 24.

In each of the examples of FIGS. 2-5, the sound enhancement device 30 is located immediately across from an intake opening 48 in the throttle body 16. In other words, each of the apertures 32 and necks 340, 440, 540 are also located directly across the air intake plenum 319, 419, 519 from the intake opening 48 of the throttle body 16. This proximity ensures that the sounds emitted from the throttle body 16 can be collected before they are attenuated within the air intake duct 19 or the plenum 319, 419, 519. With reference to FIG. 3, the sound enhancement device 30 could alternatively be located at the area circled in dashed lines shown at **30*a*, where it would block airflow to the throttle body 16 relatively less than the configuration shown in in solid lines. This alternative location at 30*a*** would result in less sound being picked up from the throttle, however.

Once sound emitted from the throttle body 16 has been amplified by the sound enhancement device 30, it can be routed to the sound duct 24 and prevented from escaping to the under-cowl environment 17 (where it would be attenuated and therefore not as noticeable to the vessel operator) by provision of a seal. The seals 350, 450, 550 shown in FIG. 3-5 are sandwiched between the air intake duct (plenum)

319, 419, 519 and the cowl 22, and prevent the amplified first subset of sounds from escaping the sound duct 24 into an open under-cowl environment 17 surrounding the engine 14, although the location and function of the seals 350, 450, 550 varies across the three embodiments. For example, the seals 350 and 450 in FIGS. 3 and 4 are provided around the aperture 32 in the air intake duct 319, 419 and between an outer surface 344, 444 of the air intake duct 319, 419 and the inner surface 46 of the cowl 22.

In FIG. 3, the sound duct 324 is routed externally of the cowl 22. This is accomplished by affixing, such as by adhering, molding, fastening, or other method, an external duct 52 made of plastic or other suitable material to the outer surface 54 of the cowl 22. The inlet end 26 of the sound duct 324 is located on top of the cowl 22 and surrounds an aperture 56 in the cowl 22, and the outlet end 28 of the sound duct 324 is located on the front side 36 of the cowl 22. Desirable sound frequencies emitted from the throttle body 16 travel across the interior of the air intake plenum 319, are amplified by the sound enhancement device 30, and travel as sound pressure pulses through the inverted neck 340. The sound pressure pulses are guided from the neck 340 through the aperture 56 in the cowl 22 by way of a sealed pathway provided by the seal 350. In this example, the seal 350 is a flexible (e.g. rubber) ring or donut situated between the outer surface 344 of the air intake duct 19 and the inlet end 26 of the sound duct 324. The sound pressure pulses then enter the sound duct 324 via the inlet end 26 and travel forwardly along the outer surface 54 of the cowl 22 until the external duct 52 ends, where they then exit the sound duct 324 via its outlet end 28. The shape and length of the external duct 52 can be designed to provide further desirable characteristics to the sound, or to attenuate undesirable characteristics. Additionally, due to the long, downwardly sloped pathway between the outer surface 54 of the cowl 22 and the external duct 52, it is highly unlikely that water would enter the cowl through the sound duct 324.

Turning to the example of FIG. 4, the sound duct 424 shown therein is routed internally of the cowl 22. This may be desirable when a larger outline of the outboard motor is not feasible due to cowl-to-transom clearance and the externally routed sound duct of FIG. 3 is therefore not an option. In the example of FIG. 4, the inlet end 26 of the sound duct 424 is located inside the cowl 22, and the outlet end 28 of the sound duct 424 is located on the front side 36 of the cowl 22. The seal 450 in this case provides a passageway 58 through which the first subset of sounds travels from the sound enhancement device 30 to the inlet end 26 of the sound duct 424. In this example, the seal 450 in fact includes several parts 450*a*, 450*b*, 450*c* that act together to make sure the sound pressure pulses do not escape to the open under-cowl environment 17. These seal parts 450*a*, 450*b*, 450*c* can be flexible (e.g. rubber) so as to route the seal from the aperture 32 in the air intake duct 19 to the inlet end 26 of the sound duct 424. The seal part 450*a* could be coupled to the inner surface 46 of the cowl 22 as shown, or could continue and be integral with the seal part 450*b*. The seal parts 450*b*, 450*c* need not be shaped exactly as shown, but rather could utilize more of the inner surface 46 of the cowl 22 and the outer surface 444 of the air intake plenum 419 for routing the sound pressure pulses. In any case, the flexibility of the seal 450 allows it to be snaked through and around other engine components without interference.

The sound duct 424 in this example is designed as sound a chamber or plenum, the shape and size of which are designed to provide certain effects to the sound emitted from the sound duct 424. The chamber can be crated by adhering, molding, fastening, or otherwise attaching a plate 60 to the inner surface 46 of the cowl 22, such as along flanges 62 of the plate 60. A grate or louvers 66 could be provided in an aperture 64 in the cowl 22 that acts as the outlet end 28 of the sound duct 424. These louvers 66 can provide certain effects to the sound and can also prevent water from entering the sound duct 424. Sound pressure pulses are thus routed from the sound enhancement device 30 through the passageway 58 defined by the seal 450, and through an aperture 68 in the plate 60 partially defining the sound duct 424. The sound pressure pulses are then modified in the interior of the sound duct 424 and exit via its outlet end 28. Of course, if there is not much space between the front of the engine 14 and the inner surface 46 of the cowl 22, the design of FIG. 3 could be used instead.

FIG. 5 shows another embodiment that can be used when there is not much space between the front of the engine 14 and the inner surface 46 of the cowl 22, and when there is no room to add an extra structure to the outer surface 54 of the cowl 22. In this example, the sound duct 524 is integral with the air intake duct (plenum) 519. Although this might require reducing some of the internal volume of the air intake plenum 519, it does provide an advantage in that fewer parts are needed and the outboard motor 20 can maintain a relatively lower profile. To provide the sound duct 524, an internal wall 70 can be provided offset from the upper wall of the air intake plenum 519. Here, because the sound enhancement device 30 is set into a neck 540 that is directly molded between the air intake plenum 519 and the sound duct 524, a seal at this location is not as necessary, as the retaining rings 42 provide a good fit. Rather, the seal 550 is provided between the outlet end 28 of the sound duct 524 and the inner surface 46 of the cowl 22. The seal 550 in this case can be a flexible ring or donut with lips for engaging an aperture 74 in the cowl 22. The outlet end 28 could be provided directly on top of the cowl 22 or could be recessed, as shown here, and provided with a partial cover 72 that limits water from entering the sound duct 524. The cover 72 is joined to the cowl 22 such that gaps 76 remain for sound to be transmitted to the area surrounding the cowl 22. The sound pressure pulses from the sound enhancement device 30 therefore travel through the inlet end 26 of the sound duct 524, between the internal wall 70 and the upper wall of the air intake plenum 519 that defines the sound duct 524, and out the outlet end 28 to the recessed area in the cowl 22, where they then are emitted from the gaps 76.

Of note is that even through the sound duct 524 is integral with the air intake duct 519, the air intake duct 519 defines a first passageway 78 that is separate and distinct from a second passageway 80 defined by the sound duct 524. In fact, in each of the examples of FIGS. 2-5, the air intake ducts 19, 319, 419, 519 define first passageways 78 that are separate and distinct from second passageways 80 defined by the sound ducts 24, 324, 424, 524. The first passageway 78 conducts intake air to the throttle body 16, while the second passageway 80 conducts sound pressure pulses to the area outside the cowl 22. The sound enhancement device 30 separates these two passageways 78, 80 from one another, and does not allow air to pass between the two passages. Rather, it is sound that is transmitted by the sound ducts.

Figure 6:
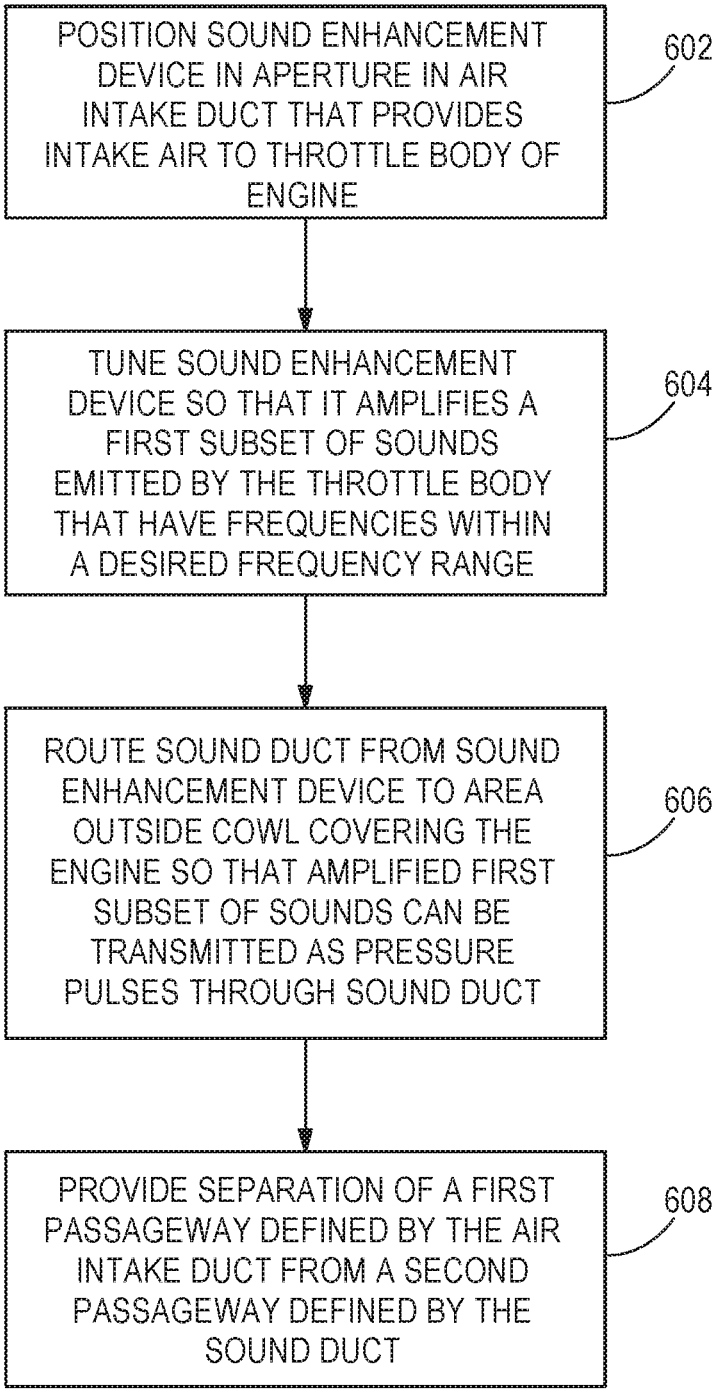
FIG. 6 illustrates a method for modifying sounds produced by an air intake system of an outboard motor.

Now turning to FIG. 6, a method for modifying sounds produced by an air intake system for an internal combustion engine 14 powering an outboard motor 20 will be described. As shown at 602, the method includes positioning a sound enhancement device 30 in an aperture 32 in an air intake duct 19, 319, 419, 519 that provides intake air to a throttle body 16 of the engine 14. This may include positioning the sound enhancement device 30 immediately opposite an intake opening in the throttle body 16 of the engine 14. As shown at 604, the method includes tuning the sound enhancement device 30 so that it amplifies a first subset of sounds 51 emitted by the throttle body 16 that have frequencies within a desired frequency range.

As shown at 606, the method also includes routing a sound duct 24, 324, 424, 524 from the sound enhancement device 30 to an area outside a cowl 22 covering the engine 14 so that the amplified first subset of sounds 51 can be transmitted as sound pressure pulses through the sound duct 24, 324, 424, 524. This may include providing the sound duct 524 integral with the air intake duct 519, as shown in FIG. 5; providing the sound duct 324 externally of the cowl 22, as shown in FIG. 3; or providing the sound duct 424 internally of the cowl 22, as shown in FIG. 4.

As shown at 608, the method includes providing separation of a first passageway 78 defined by the air intake duct 19, 319, 419, 519 from a second passageway 80 defined by the sound duct 24, 324, 424, 524. This may include sealing a pathway for the sound pressure pulses so that they are transmitted to the area outside the cowl 22 without escaping into an under-cowl environment 17 surrounding the engine 14, such as with seals 350, 450, 550. For instance, the method may include providing a seal 350, 450 around the aperture 32, between an outer surface 344, 444 of the air intake duct 319, 419 and an inlet end 26 of the sound duct 324, 424.

Each of the above examples provides a system in which the outboard motor can provide a powerful, yet refined, intake sound quality without having to compromise the functional requirements of the intake air ducts. Any of the above examples could include a removable cover and/or removable parts to provide access to the sound enhancement device 30, thereby allowing it to be tuned and/or replaced if necessary. By providing systems in which the path between the throttle body 16 and the sound enhancement device 30 is clear, the risk of under-cowl components interfering with the sound field between the two is eliminated. Additionally, for applications where the air intake duct 19, 319, 419, 519 is also a silencer, the system can be tuned to attenuate undesirable frequencies while enhancing the desirable (target) frequencies. It should be understood that the location and orientation of the throttle body 16 as shown herein is merely exemplary. The same concepts and methods can be used to position sound enhancement devices across from throttle bodies that are located elsewhere with respect to the engine and/or oriented in a different direction. The sound enhancement device can also be provided other than directly across from the intake opening 48 of the throttle body 16, although then different tuning may be required to achieve a desired effect.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. An outboard motor comprising:

an internal combustion engine powering the outboard motor;

a cowl covering the internal combustion engine;

an air intake duct routing intake air to the engine;

a throttle body metering flow of the intake air from the air intake duct into the engine;

a membrane extending across an aperture in the air intake duct, the aperture and the membrane being located directly across the air intake duct from and opposite an intake opening in the throttle body;

a sound duct having an first end located proximate the membrane and an second end located proximate an outer surface of the cowl;

wherein the membrane is tuned to amplify a subset of sounds having a desired frequency that are emitted from the throttle body; and wherein the sound duct transmits the amplified subset of sounds to an area outside the cowl.

2. The outboard motor of claim 1, further comprising a seal sandwiched between the air intake duct and the cowl that prevents the amplified subset of sounds from escaping the sound duct into an open under-cowl environment surrounding the engine.

3. The outboard motor of claim 2, wherein the seal is provided around the aperture in the air intake duct and between an outer surface of the air intake duct and an inner surface of the cowl.

4. The outboard motor of claim 3, wherein the sound duct is routed externally of the cowl, the first end of the sound duct is located on top of the cowl, and the second end of the sound duct is located on a front side of the cowl.

5. The outboard motor of claim 4, wherein the seal is a rubber ring situated between the outer surface of the air intake duct and the first end of the sound duct.

6. The outboard motor of claim 1, wherein the sound duct is routed internally of the cowl, the first end of the sound duct is located inside the cowl, and the second end of the sound duct is located on a front side of the cowl.

7. The outboard motor of claim 3, wherein the seal provides a passageway through which the amplified subset of sounds travels from the membrane to the first end of the sound duct.

8. The outboard motor of claim 2, wherein the sound duct is integral with the air intake duct, and the seal is provided between the second end of the sound duct and an inner surface of the cowl.

9. The outboard motor of claim 1, wherein the membrane is flexible.

10. The outboard motor of claim 1, wherein the air intake duct comprises an air intake plenum having an upper wall that at least partly follows a shape of an inner surface of the cowl, and the aperture is in the upper wall of the air intake plenum.

11. The outboard motor of claim 1, wherein the air intake duct defines a first passageway that is separate from a second passageway defined by the sound duct.

12. An outboard motor comprising:

an internal combustion engine powering the outboard motor;

a cowl covering the internal combustion engine;

a first passageway that is separate from an open under-cowl environment surrounding the engine, the first passageway routing intake air to the engine;

a throttle body metering flow of the intake air from the first passageway into the engine, wherein the throttle body has an intake opening situated in a first aperture in a first wall defining the first passageway;

a membrane extending across a second aperture in a second wall defining the first passageway that is opposite the first wall, the second aperture being located directly across from the first aperture and the membrane facing the throttle body's intake opening, wherein the membrane is tuned to amplify a subset of sounds having a desired frequency that are emitted from the throttle body; and a second passageway that is separate from the open under-cowl environment, the second passageway transmitting the amplified subset of sounds to an area outside the cowl.

13. The outboard motor of claim 12, wherein the second passageway is routed internally of the cowl.

14. The outboard motor of claim 12, wherein the second passageway transmits the amplified subset of sounds to a front side of the cowl.

15. The outboard motor of claim 12, wherein the membrane is flexible.

* * * * *